US005458339A

United States Patent [19]

Wildes

[11] Patent Number: 5,458,339

[45] Date of Patent: Oct. 17, 1995

[54] GOLF BALL SETTING APPARATUS

[76] Inventor: David Wildes, 1711 Pamela Cir., Norman, Okla. 73071

[21] Appl. No.: 272,038

[22] Filed: Jul. 8, 1994

[51] Int. Cl.[6] ..... A63B 69/00

[52] U.S. Cl. ..... 273/201

[58] Field of Search ..... 273/201

[56] References Cited

U.S. PATENT DOCUMENTS

| | | | |
|---|---|---|---|
| 1,868,261 | 7/1932 | Spencer | 273/201 |
| 2,285,342 | 6/1942 | MacLellan | 273/201 |
| 3,294,402 | 12/1966 | Scott | 273/201 |
| 3,448,985 | 6/1969 | Scott | 273/201 |
| 3,758,118 | 9/1973 | Willcox | 273/201 |
| 4,265,453 | 5/1981 | Loof | 273/201 |
| 4,575,092 | 3/1986 | Watson | 273/201 |
| 4,616,826 | 10/1986 | Trefts | 273/32.5 |
| 4,819,938 | 4/1989 | Hill | 273/32.5 |
| 4,949,961 | 8/1990 | Milano | 273/32.5 |
| 4,957,296 | 9/1990 | Turnidge et al. | 273/201 |
| 4,969,646 | 11/1990 | Tobias | 273/32.5 |
| 4,995,614 | 2/1991 | Tange | 273/201 |
| 5,080,357 | 1/1992 | Wolf | 273/32.5 |
| 5,326,107 | 7/1994 | Park | 273/201 |
| 5,346,222 | 9/1994 | Luther, Sr. | 273/201 |

*Primary Examiner*—Vincent Millin
*Assistant Examiner*—Steven B. Wong
*Attorney, Agent, or Firm*—Craig W. Roddy

[57] ABSTRACT

An apparatus for setting a golf ball on a tee including: a base having attached supports to provide a framework around which the apparatus is constructed; a tee coupled with the base; a holder for holding a plurality of golf balls; a dislodger to free balls that are lodged within the holder; a rocker arm for individually releasing the balls onto a ramp; and a lever for controlling the rocker arm and ramp, wherein the ball is delivered and placed on the tee.

18 Claims, 4 Drawing Sheets

GOLF BALL SETTING APPARATUS

BACKGROUND

The present invention relates generally to a golf ball setting apparatus, and more particularly, to an apparatus for setting a golf ball on a pre-positioned tee, wherein the ball is ready for play without requiring any appreciable bending or stooping on the part of the player.

Numerous innovations have been developed to assist persons playing golf. A number of devices have been specifically designed to aid individuals having physical maladies thereby making it possible for such individuals to be more self-sufficient when playing the game of golf. In particular, many people suffer from back injuries or diseases which prevent them from effectively bending or stooping therefore making it practically impossible for such individuals to position a ball on a tee.

Many of the known implements for setting golf balls require the golfer to stand and to use delicate movements for positioning the ball. In addition, these implements often require golfers to lay their golf club aside each time the implement is operated.

The present invention is especially useful in repeatedly setting golf balls on a tee while practicing at a golf driving range. For the foregoing reasons there is a need for a simple, economical and effective golf ball setting apparatus; however, until now, no such apparatus has been developed.

SUMMARY

The present embodiment of the invention is directed to an apparatus which provides a simple, economical and effective means of setting a golf ball on a tee.

More specifically, the golf ball setting apparatus comprises a base having attached supports to provide a framework around which the apparatus is constructed; a tee coupled with the base; a means for anchoring the base to the ground; a holder for holding a plurality of golf balls; a ball dislodger to free balls that are lodged within the holder; a rocker arm for individually releasing the balls onto a ramp; and a lever for controlling the rocker arm and ramp wherein the ball is delivered and placed on the tee. Thus, the apparatus sets the golf ball on the tee without requiring the golfer to displace the golf club being used or to use any appreciable bending or stooping.

As such, it is a first object of the embodiment of the invention to provide an efficient, economical, and simple golf ball setting apparatus for aiding golfers in teeing up balls.

It is a further object of the embodiment of the invention to provide a golf ball setting apparatus which is portable.

It is a further object of the embodiment of the invention to provide a golf ball setting apparatus which has a pre-positioned tee for repeatedly setting balls thereon.

It is a further object of the embodiment of the invention to provide a golf ball setting apparatus which permits a golfer to place the ball on the tee without bending or stooping.

It is a final object of the embodiment of the invention to provide a golf ball setting apparatus which does not require the golfer to be in a standing position for operation thereof.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
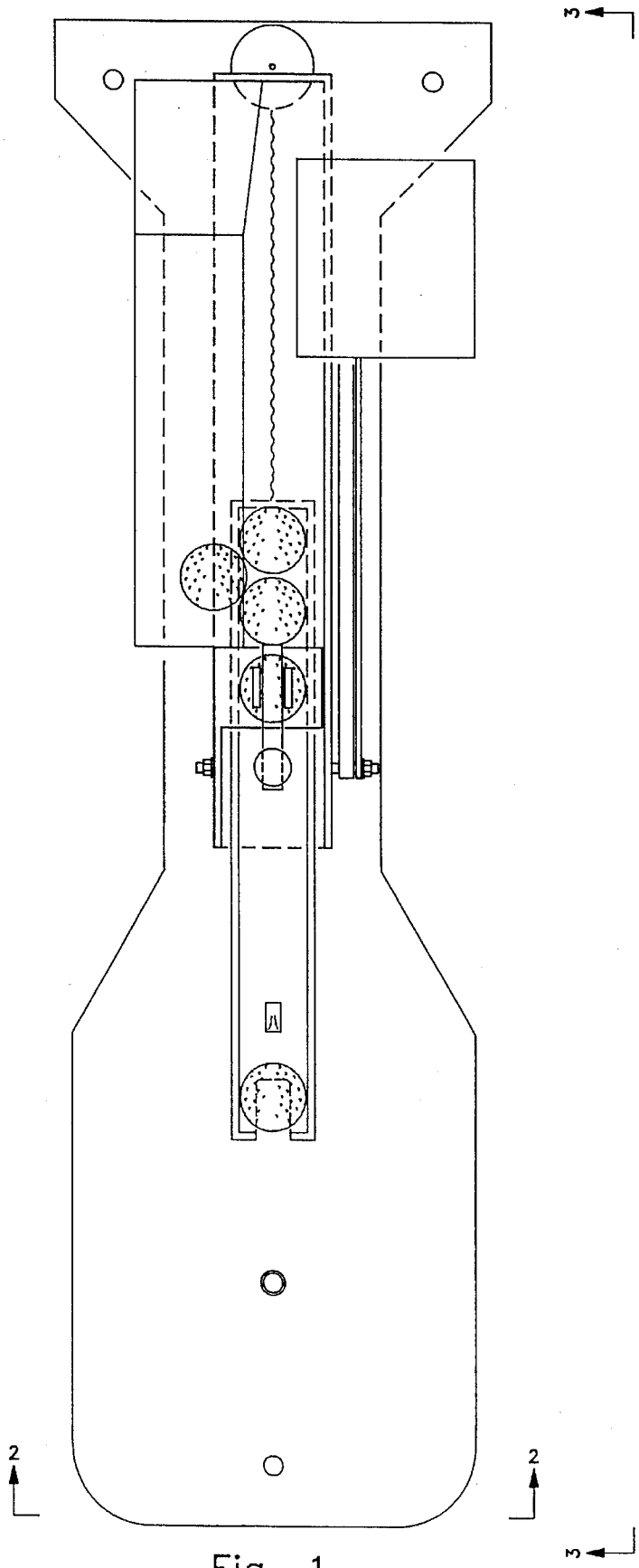
FIG. 1 is a top plan view of the golf ball setting apparatus constructed in accordance with the present embodiment of the invention, wherein the apparatus is halfway between retracted and extended positions.
Figure 2:
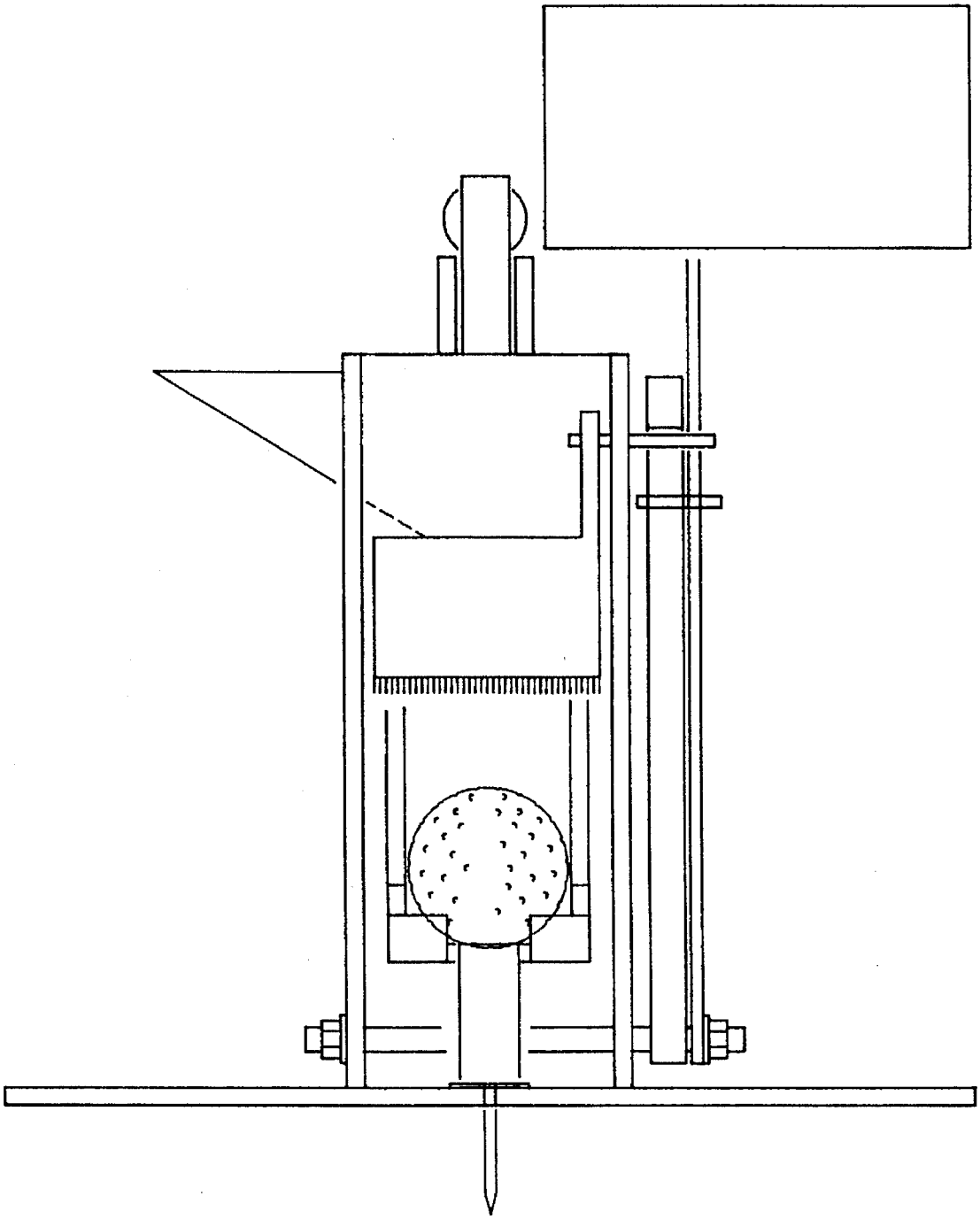
FIG. 2 is a front elevation view of the golf ball setting apparatus of FIG. 1.

As best illustrated in FIG. 1, the present embodiment of the invention relates to an apparatus 10 for setting a golf ball 12 on a tee 14. The apparatus 10 is particularly useful at a driving range where a golfer repeatedly tees and hits golf balls from a single location.

As shown in FIG. 1, a base 16 is used to support the apparatus 10 and is substantially flat for lying against the ground. Supports 18, such as upstanding sidewalls or the like, are attached to the base 16 and generally form a framework for supporting attached components of the apparatus 10.

The base 16 and supports 18 are preferably made of a rigid material such as plastic, metal or wood. Further, the base 16 and supports 18 may be constructed using metal rods or similar materials which significantly reduce the weight of the apparatus 10 and increase the portability thereof.

The base 16 is preferably elongated with distant ends, wherein the supports 18 are generally located towards one end thereof. Further, the base 16 includes a plurality of apertures 20 to accept anchor means 22, such as spikes, therethrough for anchoring the apparatus 10 to the ground. Thus, the apparatus 10 is securely anchored during use and is easily moved to another location by removing the anchor means 22 and positioning the apparatus 10 at a new location.

The tee 14 for setting the golf ball 12 thereon is coupled to the end of the base 16, which is generally located away from the supports 18, and is substantially perpendicular to the ground and base 16 during use. The tee 14 is preferably replaceable and may be attached to the base 16 using a known adhesive, or may be securely inserted into or through an opening defined in the base 16. The tee 14 is made of a somewhat flexible material such as rubber tubing, wherein the tee 14 bends and returns to its normal state if it is hit with a golf club.

Located atop the supports 18 is a holder 24 for retaining one or more of the golf balls 12 therein. The holder 24 is supportably attached to the supports 18, whereby the balls 12 roll towards a lowest portion 26 thereof which is located nearest the tee 14.

Referring again to FIG. 1, the preferred holder 24 is integrally constructed with the supports 18 using a rigid material, and may obviously be constructed using various configurations. The holder 24 is designed such that only one ball 12 at a time will reach the lowest portion 26; thus, the balls 12 are individually moved from the holder 24 to the tee 14.

A somewhat L-shaped member referred to herein as a dislodger 28 is mounted in cooperation with the holder 24. The dislodger 28 has a spring 30, a first push pad 32 and a first pivotal attachment 34. The pad 32 is located on an upper exposed end of the dislodger 28 while the pivotal attachment 34 is somewhat centrally positioned thereon to serve as a fulcrum.

When the pad 32 is pressed, the dislodger 28 pushes against the spring 30 and pivots about the attachment 34. Therefore, the dislodger 28 end located opposite the pad 32 is cooperatively moved within the holder 24 such that any balls 12 lodged therein are forced to freely move towards the lowest portion 26 of the holder 24.

Again referring to FIG. 1, a ramp 36 is generally interposed and movably connected to the supports 18. The ramp 36 is a substantially flat, elongated member having an upward lip 38 defined around its perimeter for retaining the ball 12 on the ramp 36. Further, the ramp 36 has a U-shaped notch 40 in one end thereof which allows the ramp 36 to be partially received around the tee 14 during placement of the ball 12 thereon.

Additionally, a ball stopper 42 is centrally located on the ramp 36, generally towards the notch 40. The ball stopper 42 is preferably a flat, somewhat curved piece of pliable metal which is glued or riveted to the ramp 36 such that it is biased away from the base 16 and towards the tee 14. Hence, the stopper 42 allows the ball 12 to roll thereover and prevents it from returning back up the ramp 36 once it has passed thereover.

The end of the ramp 36, which is located opposite the notch 40, has a first slide bar 44 mounted thereto. The bar 44 is perpendicular to the elongated portion of the ramp 36 and extends through first slots 46 located in or formed by the supports 18. During operation, the slots 46 ensure aligned movement of the ramp 36 towards the tee 14.

In addition, the slots 46 each have a curved portion which is located nearest the tee 14 and is curved towards the base 16. The curved portions allow the ramp 36 to be lifted as it is fully extended towards the tee 14. Thus, the ball 12 is lifted over the tee 14 and placed thereon by the extended ramp 36, which is controlled by the first slide bar 44 moving through the slots 46.

A ramp guide sleeve 48 interposes the supports 18 for holding and guiding the ramp 36 towards the tee 14. Positioned adjacent the sleeve 48 and contained ramp 36 is a somewhat U-shaped rocker arm 50 which regulates the release of balls 12 from the holder 24 onto the ramp 36, see FIGS. 3-4. The rocker arm 50 is attached to a second slide bar 52 which moves through a curved second slot 54 in the support 18 to control the action thereof.

As shown in FIGS. 1–4, a push lever 56 is pivotally attached to the supports 18 using bolts or pivot pins known in the art. The lever 56 is attached to the supports 18 at a position generally nearest to the tee 14 and extends parallel to the supports 18 for movably passing thereby during operation.

Figure 3:
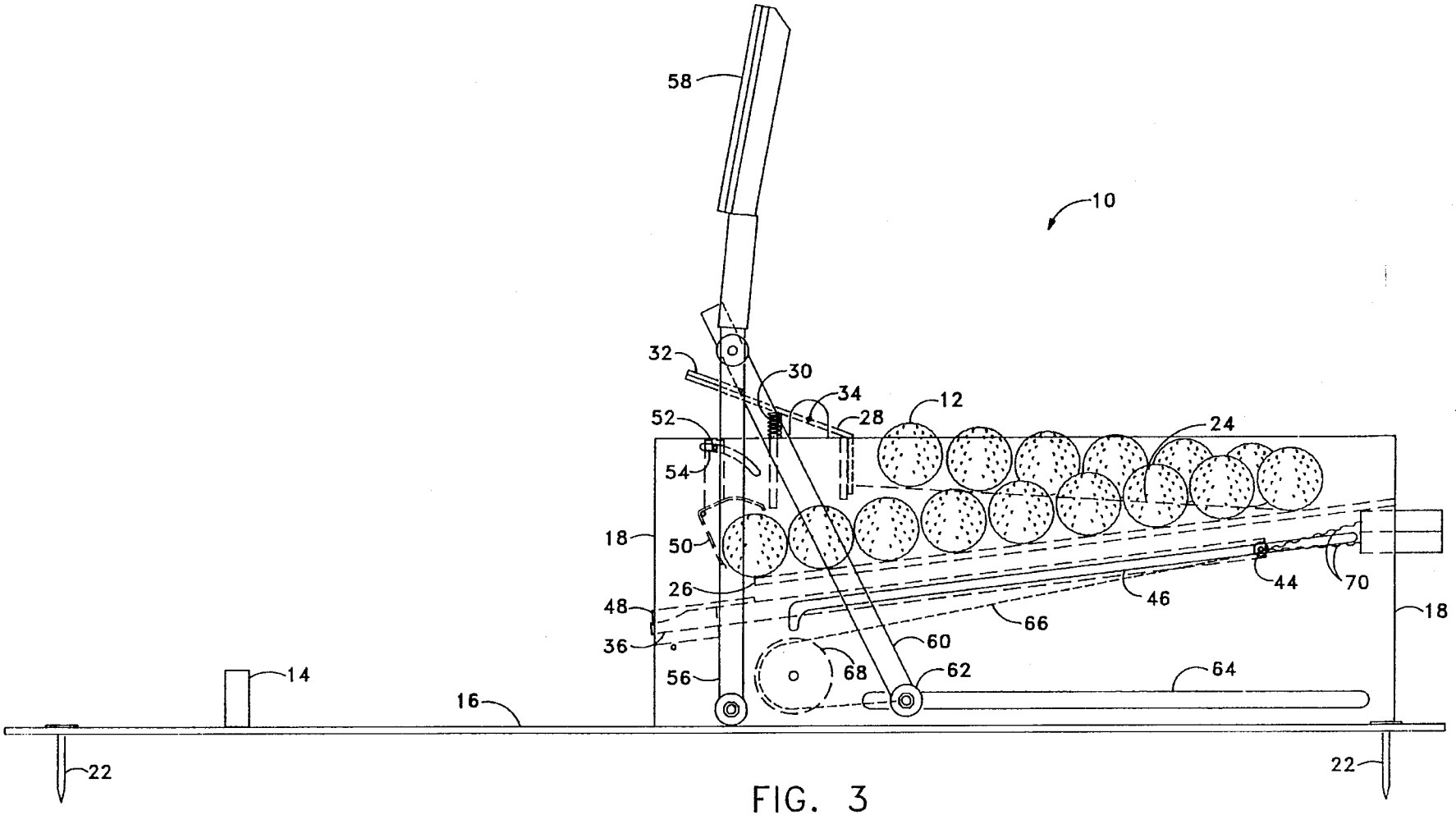
FIG. 3 is a right side elevation view of the golf ball setting apparatus of FIG. 1, wherein the apparatus is in the retracted position and ready for use.

The lever 56 rests against the second slide bar 52 when in the unoperated and retracted position as shown in FIG. 3, whereby the rocker arm 50 is positioned to prevent release of the balls 12 onto the ramp 36. When the lever 56 is pivotally moved, the second slide bar 52 is allowed to freely move through the second slot 54. Hence, one ball 12 is released from the holder 24, via the rocker arm 50, onto the ramp 36 while the balls 12 remaining in the holder 24 are prevented from entering thereon.

The lever 56 is preferably an elongated member constructed of rigid materials such as metal or plastic. A second push pad 58 is attached to an extended end of the lever 56, wherein the golfer applies force to the pad 58, preferably with a golf club, for actuating the apparatus 10.

An extension arm 60 is pivotally coupled with the lever 56 to provide support for the lever 56 and to assist in mechanically operating the apparatus 10. The extension arm 60 is perpendicularly attached with a third slide bar 62 that extends through a third slot 64 of the supports 18. As the lever 56 is pivoted, the extension arm 60 and third slide bar 62 move generally parallel to the base 16 and away from the tee 14.

Figure 4:
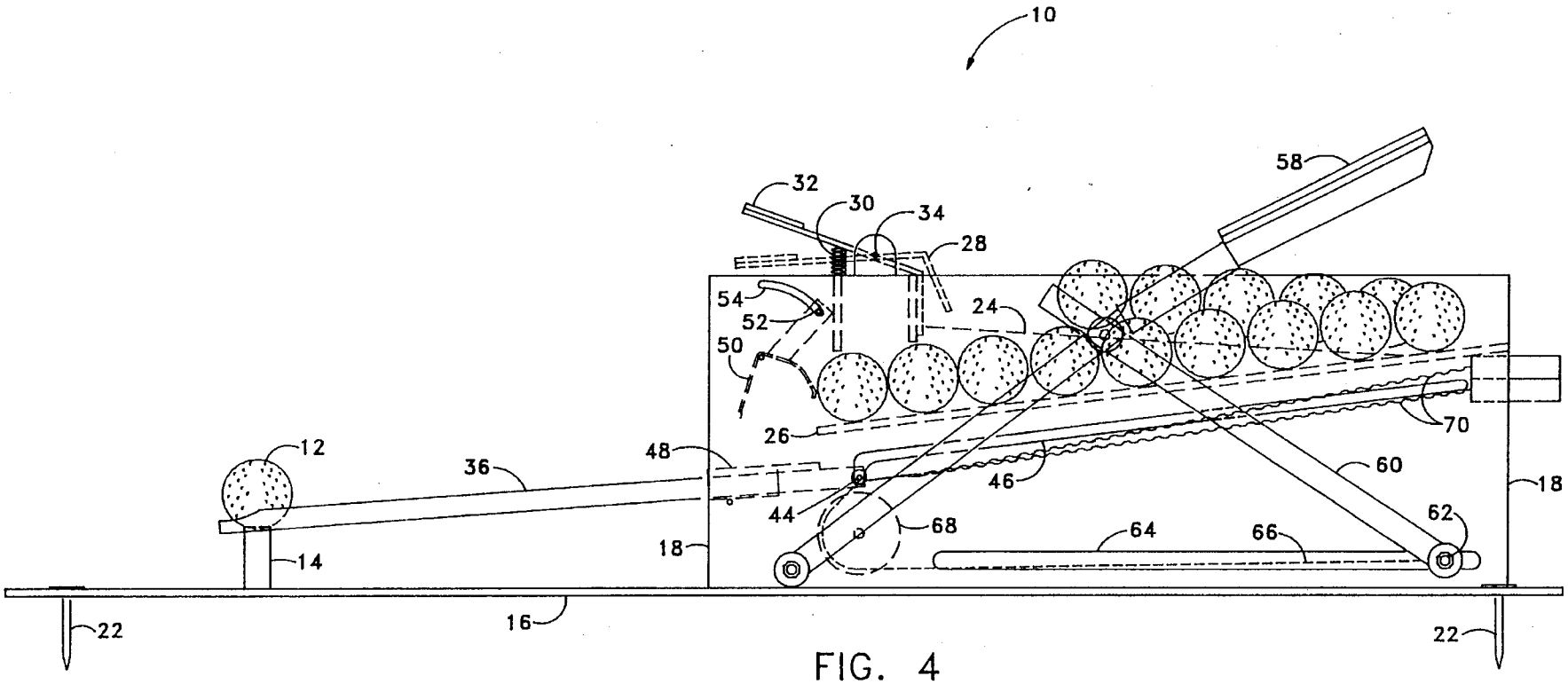
FIG. 4 is a view of the apparatus shown in FIG. 3, wherein the apparatus is in the extended position for placing the ball on the tee.

In FIGS. 3 and 4, connected to the third slide bar 62 is a cable 66 which extends from the third slide bar 62 through a pulley 68 and to the first slide bar 44. The pulley 68 is located near the pivotal attachment of the lever 56 and is interposed between the supports 18.

The ramp 36 has an indentation located adjacent the bar 44 which allows easy access to the bar 44 for connection of the cable 66 thereto. Further, a return spring 70 is attached between the first slide bar 44, generally near the cable 66 which is attached thereto, and the support 18. By way of example, the spring 70 may consist of a retractable spring and chain mechanism such as those commonly used with known key chain devices. The spring 70 is preferably mounted to the supports 18 and the ramp 36, wherein the spring 70 is aligned with the ramp 36 and will apply sufficient force to pull the ramp 36 away from the tee 14 as the lever 56 is released by the golfer.

OPERATION OF THE PREFERRED EMBODIMENT

As the golfer pivotally pushes the lever 56 away from the tee 14, the connected extension arm 60 and third slide bar 62 move away from the tee 14 via the third slot 64. The cable 66, which is attached to the first and third slide bars 44, 62, extends around the pulley 68 to produce a somewhat U-shaped movement of the cable 66 therebetween. Thus, as the third slide bar 62 moves away from the tee 14, the cable 66 travels around the pulley 68 and slidably moves the ramp 36 through the sleeve 48 and in the direction of the tee 14.

Furthermore, as the lever 56 moves the extension arm 60, the second slide bar 52 freely moves through the second slot 54 to operate the rocker arm 50. The rocker arm 50 releases one ball 12 from the holder 24 onto the ramp 36. Thus, the ramp 36 is advanced to the tee 14 with the ball 12 placed thereon.

As the ramp 36 nears the tee 14, the notch 40 is generally received therearound while the ramp 36 is slightly lifted by the first slide bar 44 moving through the curved slots 46. The ball 12 located on the ramp 36 is then positioned over the tee 14.

When the golfer releases the lever 56, the spring 70 pulls the ramp 36 away from the tee 14. The notch 40 allows the ramp 36 to lower around the tee 14 as the first slide bar 44 moves from the curved portion of the slots 46, thus, setting the ball 12 on the tee 14. The spring 70 causes the ramp 36, rocker arm 50, lever 56 and extension arm 60 to return to their original and retracted positions.

The apparatus 10 components are sufficiently retracted and removed from the tee 14 which allows unobstructed hitting of the ball 12 therefrom using a golf club. It is obvious the apparatus 10 can hold numerous balls 12 thereby providing repeated operation without bending or stooping. Furthermore, it is obvious that the lever 56 may be operated using an electric motor and switch or sensor means known in the art.

The previously described versions of the invention have many advantages, including a simple and economic way of setting a golf ball 12 on a tee 14. The apparatus 10 prevents the golfer from having to bend or stoop when teeing up the ball 12, and can be used by a golfer in a wheelchair.

While the preferred use of the present version of the invention is for setting a golf ball on a tee at a driving range, it is obvious that the apparatus has many applications. Therefore, the foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for setting a golf ball on a tee, comprising:

a base;

a holder for holding the golf ball, said holder is coupled with said base;

a ramp for receiving the golf ball from said holder, said ramp is movable for setting the golf ball on the tee;

a lever for controlling the movement of said ramp;

an extension arm coupled to said lever;

a slide bar attached to said extension arm;

a slide bar attached to said ramp; and a cable connected between said slide bars.

2. An apparatus as recited in claim 1, further comprising:

a rocker arm for releasing the golf ball from said holder onto said ramp, wherein said rocker arm is attached to a slide bar.

3. An apparatus as recited in claim 1, further comprising:

a means for dislodging golf balls, wherein said means for dislodging is pivotally mounted in cooperation with said holder.

4. An apparatus as recited in claim 3, wherein said means for dislodging includes:

a somewhat L-shaped member; and a spring.

5. An apparatus as recited in claim 2, wherein:

the slide bar moves through a slot to control said rocker arm.

6. An apparatus for setting a golf ball on a tee, comprising:

a base;

a holder for holding the golf ball, said holder is coupled with said base;

a ramp for receiving the golf ball from said holder, said ramp is movable for setting the golf ball on the tee;

a lever for controlling the movement of said ramp;

means for releasing the golf ball from said holder onto said ramp, said means for releasing includes a rocker arm attached to a slide bar; and wherein the slide bar moves through a slot to control the rocker arm.

7. An apparatus as recited in claim 6, further comprising:

a means for connecting said lever and said ramp.

8. An apparatus as recited in claim 7, wherein said means for connecting includes:

an extension arm pivotally coupled to said lever; and a cable attached between said extension arm and said ramp.

9. An apparatus as recited in claim 7, wherein said means for connecting includes:

an extension arm coupled to said lever;

a slide bar attached to said extension arm;

a slide bar attached to said ramp; and a cable connected between said slide bars.

10. An apparatus as recited in claim 6, further comprising:

a means for dislodging golf balls, wherein said means for dislodging is pivotally mounted in cooperation with said holder.

11. An apparatus as recited in claim 10, wherein said means for dislodging includes:

a somewhat L-shaped member; and a spring.

12. An apparatus for setting a golf ball on a tee, comprising:

a base;

a holder for holding the golf ball, said holder is coupled with said base;

a ramp for receiving the golf ball from said holder, said ramp is movable for setting the golf ball on the tee;

a lever for controlling the movement of said ramp;

means for dislodging golf balls, said means for dislodging is pivotally mounted in cooperation with said holder; and wherein said means for dislodging includes a somewhat L-shaped member and a spring.

13. An apparatus as recited in claim 12, wherein:

said means for dislodging is independently operated.

14. An apparatus as recited in claim 12, further comprising:

a means for connecting said lever and said ramp.

15. An apparatus as recited in claim 14, wherein said means for connecting includes:

an extension arm pivotally coupled to said lever; and a cable attached between said extension arm and said ramp.

16. An apparatus as recited in claim 14, wherein said means for connecting includes:

an extension arm coupled to said lever;

a slide bar attached to said extension arm;

a slide bar attached to said ramp; and a cable connected between said slide bars.

17. An apparatus as recited in claim 12, further comprising:

a rocker arm for releasing the golf ball from said holder onto said ramp, wherein said rocker arm is attached to a slide bar.

18. An apparatus as recited in claim 17, wherein:

the slide bar moves through a slot to control said rocker arm.

* * * * *